US007797784B2

(12) United States Patent
Chang

(10) Patent No.: US 7,797,784 B2
(45) Date of Patent: Sep. 21, 2010

(54) NET FOR MAKING BODY SCRUBBING TOOL

(76) Inventor: Che Yuan Chang, No. 1, Lane 147, Sec. 2, Chung San Rd., Yun Lin, Chang Hua Hsien (TW)

( * ) Notice: Subject to any disclaimer, the term of this patent is extended or adjusted under 35 U.S.C. 154(b) by 286 days.

(21) Appl. No.: 11/844,795

(22) Filed: Aug. 24, 2007

(65) Prior Publication Data

US 2009/0053440 A1 Feb. 26, 2009

(51) Int. Cl.

| | |
|---|---|
| ***A47K 7/02*** | (2006.01) |
| ***A47L 1/06*** | (2006.01) |
| ***A47L 13/10*** | (2006.01) |
| ***A47L 24/04*** | (2006.01) |
| ***A47L 25/00*** | (2006.01) |
| ***B43L 21/00*** | (2006.01) |

(52) U.S. Cl. ..... 15/209.1; 15/208; 15/114; 15/210.1; 206/77.1

(58) Field of Classification Search ..... 15/208, 15/209.1, 114, 210.1; 206/77.1
See application file for complete search history.

(56) References Cited

U.S. PATENT DOCUMENTS 6,047,433 A * 4/2000 Chang ..... 15/222

* cited by examiner

*Primary Examiner*—Michael C Miggins
(74) *Attorney, Agent, or Firm*—Browdy and Neimark, P.L.L.C.

(57) ABSTRACT

A net for making body scrubbing tool includes a tubular net body and at least one member fastened to the tubular net body and made from a material different from that of the tubular net body. In this way, a body scrubbing tool constructed from the net has a better foam forming capacity and variant roughness on variant portion thereof so as to provide a satisfactory cleaning effect.

10 Claims, 5 Drawing Sheets

NET FOR MAKING BODY SCRUBBING TOOL

BACKGROUND OF THE INVENTION

1. Field of the Invention

The present invention relates generally to a body scrubbing tool, such as a bathing ball, and more specifically to a net used to construct a body scrubbing tool, which can not only generate foam quickly and extensively but also provide variant roughness on variant portion thereof so as to improve the cleaning effect.

2. Description of the Related Art

A conventional body scrubbing tool, such as a bathing ball, is generally made of a belt of net or an elongated single piece of net. However, because the aforesaid bathing ball is made of a net having a single-layer sheet structure, it can not generate foam quickly and extensively when it is in use. In another aspect, a lot of cleanser needs to be used in order to generate a large amount of foam when using the conventional bathing ball made of the net of a single-layer structure. This is cost-consuming.

Therefore, it is desirable to provide an improved net which enables a body scrubbing tool made thereby to eliminate the aforesaid drawbacks.

SUMMARY OF THE INVENTION

The primary objective of the present invention is to provide a net for making body scrubbing tool, which enables the body scrubbing tool made therefrom to generate foam quickly and extensively with less usage of cleanser.

It is another objective of the present invention to provide a net for making body scrubbing tool, which enables the body scrubbing tool made therefrom to provide variant roughness on variant portion of the body scrubbing tool so as to improve the cleaning effect when it is in use.

In order to achieve the aforesaid objectives, the net for making body scrubbing tool of the present invention comprises a tubular net body and at least one member fastened to the tubular net body and made from a material different from that of the tubular net body. In this way, a body scrubbing tool constructed from the net has a better foam forming capacity and variant roughness on variant portion thereof so as to provide a satisfactory cleaning effect.

Further, the tubular net body and the member of the net for making body scrubbing tool of the present invention may have different color, so that a body scrubbing tool made therefrom may have both a cleaning effect and a sense of beauty.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
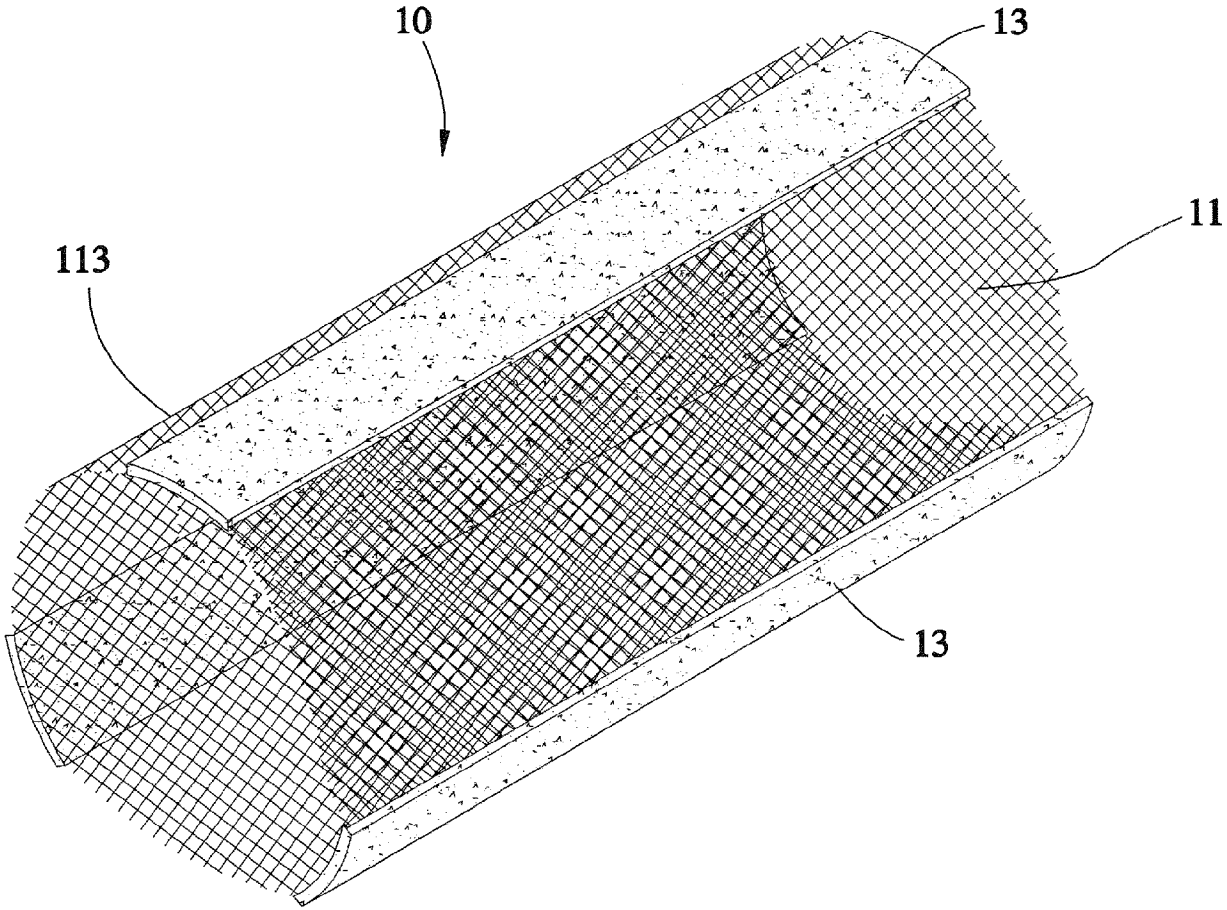
FIG. 1 is a perspective view of a net for making body scrubbing tool according to a first preferred embodiment of the present invention.

As shown in FIG. 1, a net 10 for making body scrubbing tool in accordance with a first preferred embodiment of the present invention comprises a tubular net body 11 and three members 13 fastened to the tubular net body 11. The members 13 are made from a material that is different from that of the tubular net body 11.

The tubular net body 11 can be made from a polymer material such as polyvinyl alcohol (PVA), polyvinylchloride (PVC) or polyethylene (PE), which is intensively used in making the conventional bathing ball. Besides, the size and shape of mesh of the tubular net body 11 are not limited. In addition, there is no specific limit on the color of the tubular net body 11. It may have one or more colors.

The three members 13, which are embodied as but not limited to an elongated strip in this embodiment, are longitudinally and equidistantly fastened on three portions of an outer periphery 113 of the tubular net body 11. Of course, one or more members 13 can be used to be equidistantly or non-equidistantly fastened on the outer periphery 113 or an inner periphery of the tubular net body 11 in practice.

The members 13 are made from a material, such as cloth or sponge, different from the polymer material of the tubular net body 11. Further, the three members 13, which can be independently or simultaneously made form cloth or sponge, can be fastened on the outer periphery 113 of the tubular net body 11 by stitching, hot welding or adhesive.

Figure 5:
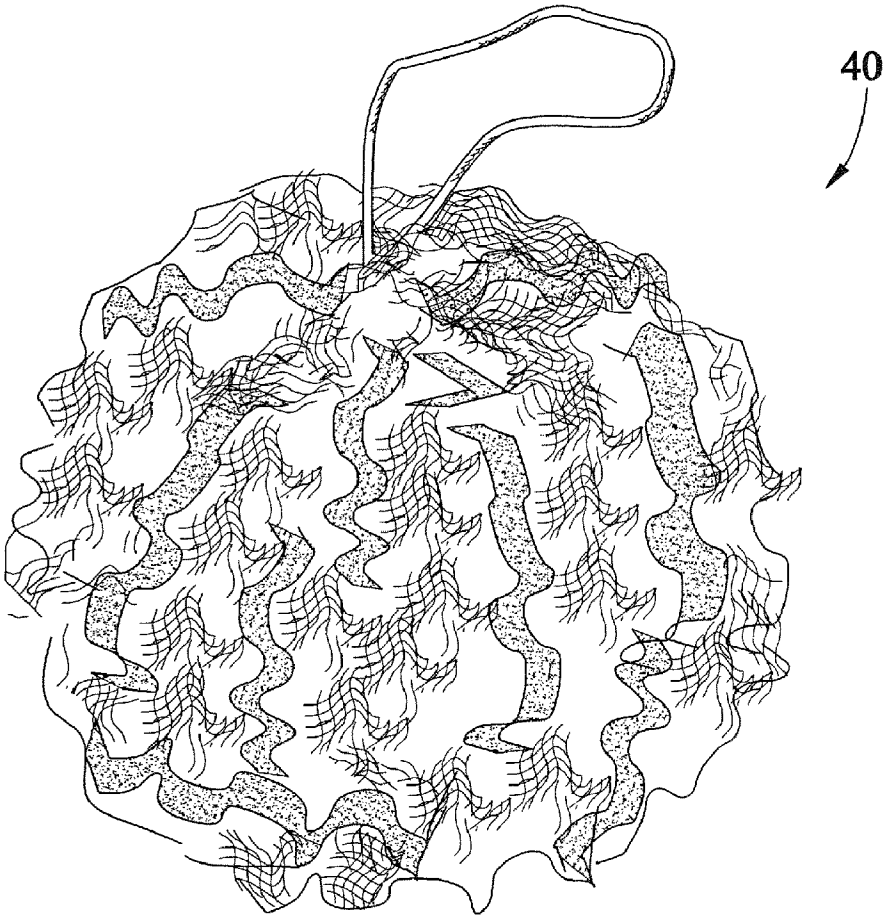
FIG. 5 is a schematic drawing showing a bathing ball constructed from the net according to the first preferred embodiment of the present invention.

As stated above, a body scrubbing tool, such as a bathing ball 40 constructed by the net 10 of the present invention as shown in FIG. 5, has the tubular net body 11 and the members 13 made by two or more different materials, thereby enhancing a foam forming capacity thereof. Further, the bathing ball 40 can provide variant roughness on variant portion thereof, increasing the friction force between the bathing ball and the body skin on which the bathing ball rubs so as to remove dirt from the user's body skin easily.

Figure 2:
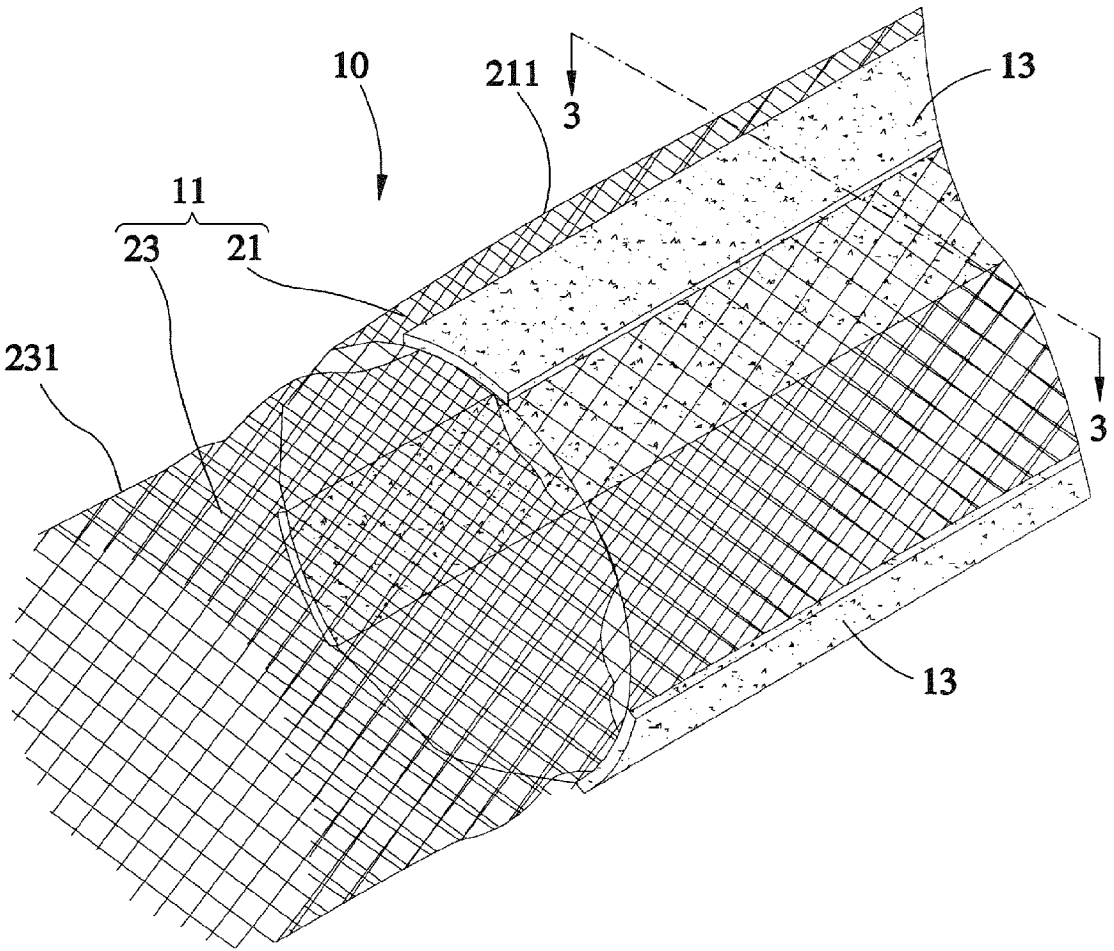
FIG. 2 is a perspective view of a net for making body scrubbing tool according to a second preferred embodiment of the present invention.
Figure 3:
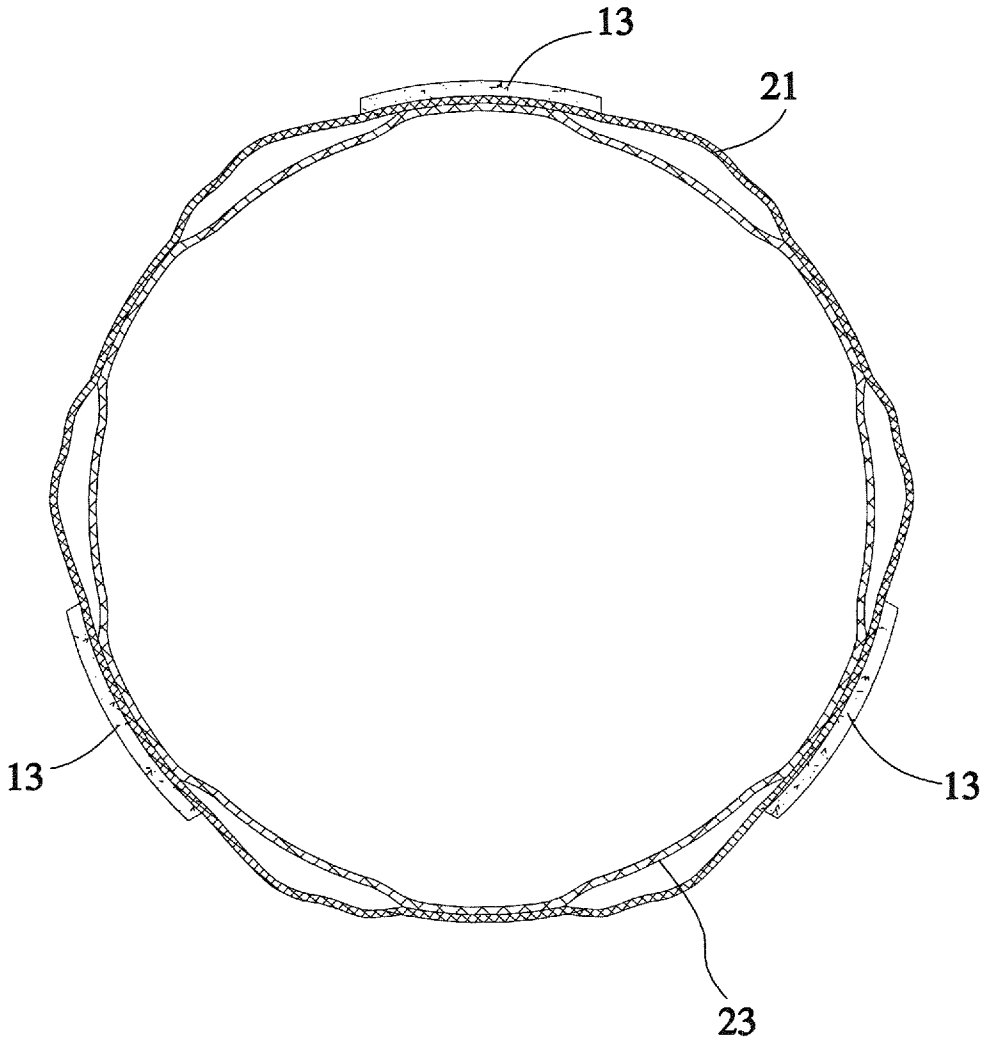
FIG. 3 is a cross-sectional view taken along line 3-3 of FIG. 2, showing that the tubular net body includes a first tubular layer and a second tubular layer sleeved into and fastened with the first tubular layer.
Figure 4:
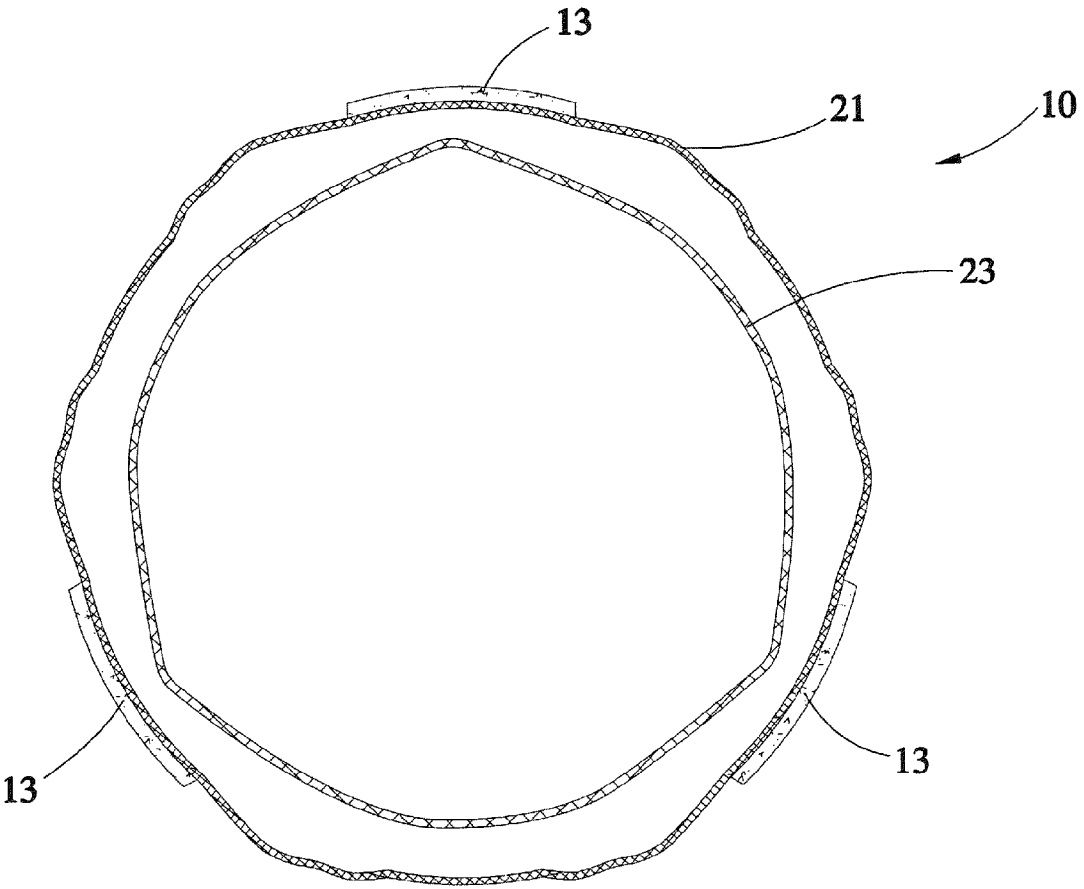
FIG. 4 is a cross-sectional view of an alternative form of the net according to the second preferred embodiment of the present invention, showing that the second tubular layer is sleeved into but not fastened with the first tubular layer of the tubular net body.

FIGS. 2 and 3 are perspective and cross-sectional views of a net 10 for making body scrubbing tool according to a second preferred embodiment of the present invention respectively. The net 10 of this embodiment also comprises a tubular net body 11 and three members 13 fastened to the tubular net body 11 and made from a material different from that of the tubular net body 11. The main difference between this embodiment and the first preferred embodiment is in that the tubular net body 11 has a double-layer structure including a first tubular layer 21 and a second tubular layer 23 sleeved into and fastened with the first tubular net body 11. FIG. 4 shows an alternative form of the double-layer net 10. In this alternative form, the second tubular layer 23 is sleeved into but not fastened to the first tubular layer 21 of the tubular net body 10. Besides, the three members 13 are longitudinally and equidistantly fastened on three portions of an outer periphery 211 of the first tubular layer 21 in this embodiment. However, it would be easily understood for a person skilled in the art that one or more members 13 can be equidistantly or nonequidistantly fastened to the outer and/or inner peripheries of the first tubular layer 21 and/or the outer and/or inner peripheries of the second tubular layer 23 independently or simultaneously.

In conclusion, the net 10 for making body scrubbing tool according to the second embodiment or its alternative form includes the tubular net body 11 of a double-layer structure having the first tubular layer 21 and the second tubular layer 23, and the members 13, which can be fastened on one or more portions of at least one of the first tubular layer 21 and the second tubular layer 23 independently or simultaneously, so that a body scrubbing tool constructed therefrom may provide a better foam forming capacity and a better cleaning effect.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A net for making a body scrubbing tool, comprising:

a tubular net body comprising a first tubular layer having an outer periphery and a second tubular layer sleeved into the first tubular layer; and at least one member fastened on a portion of the outer periphery of the first tubular layer and made of a material different from those of the first tubular layer and the second tubular layer.

2. The net according to claim 1, wherein the first tubular layer and the second tubular layer are fastened together.

3. The net according to claim 1, wherein the first and second tubular layers are made from different materials.

4. The net according to claim 1, wherein the first and second tubular layers have different mesh sizes.

5. The net according to claim 1, wherein the first and second tubular layers have different colors.

6. The net according to claim 1, wherein the at least one member is made of cloth or sponge.

7. The net according to claim 1, wherein the at least one member is longitudinally fastened on the portion of the outer periphery of the first tubular layer.

8. The net according to claim 1, wherein the first and second tubular layers are made of materials which are the same.

9. The net according to claim 1, wherein the first and second tubular layers have mesh sizes which are the same.

10. The net according to claim 1, wherein the first and second tubular layers are of colors which are the same.

* * * * *